US009856678B2

(12) United States Patent
Yang

(10) Patent No.: US 9,856,678 B2
(45) **Date of Patent: *Jan. 2, 2018**

(54) ANTI-FRAUD TAG

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/134,251

(22) Filed: Apr. 20, 2016

(65) Prior Publication Data

US 2016/0230424 A1 Aug. 11, 2016

Related U.S. Application Data

(63) Continuation of application No. 14/606,351, filed on Jan. 27, 2015, now Pat. No. 9,324,221, which is a continuation-in-part of application No. 14/099,788, filed on Dec. 6, 2013, now Pat. No. 9,355,539.

(60) Provisional application No. 61/734,478, filed on Dec. 7, 2012.

(51) Int. Cl.

| | |
|---|---|
| ***G08B 13/14*** | (2006.01) |
| ***E05B 73/00*** | (2006.01) |
| ***G08B 13/24*** | (2006.01) |

(52) U.S. Cl.

CPC ..... *E05B 73/0017* (2013.01); *G08B 13/2434* (2013.01)

(58) Field of Classification Search

CPC ..... G06K 19/07749
USPC ..... 340/572.1; 24/704.1
See application file for complete search history.

(56) References Cited

U.S. PATENT DOCUMENTS

| | | | |
|---|---|---|---|
| 5,524,463 | A | 6/1996 | Schenkel et al. |
| 5,583,489 | A | 12/1996 | Loemker et al. |
| 5,945,909 | A | 8/1999 | Kolton |
| 5,969,613 | A | 10/1999 | Yeager et al. |
| 6,023,951 | A | 2/2000 | Maurer et al. |
| 6,339,378 | B2 | 1/2002 | Seidel |
| 6,535,130 | B2 | 3/2003 | Nguyen et al. |
| 6,624,753 | B2 | 9/2003 | Elston |
| 6,724,311 | B1 | 4/2004 | Kolton et al. |
| 6,754,939 | B2 * | 6/2004 | Belden, Jr. ..... E05B 73/0017 24/704.1 |
| 7,005,989 | B2 | 2/2006 | Benoit et al. |
| 7,073,236 | B2 | 7/2006 | Xue et al. |
| 7,075,435 | B2 | 7/2006 | Jesser |
| 7,148,805 | B2 | 12/2006 | Hogan |
| 7,183,917 | B2 | 2/2007 | Piccoli et al. |

(Continued)

*Primary Examiner* — Tai T Nguyen
*Assistant Examiner* — Israel Daramola
(74) *Attorney, Agent, or Firm* — Robert R. Waters; Brian W. Foxworth; Waters Law Group, PLLC

(57) ABSTRACT

A highly visible single use tag prevents the fraudulent return of garments. Two members are connected by a hinge. The hinge allows the members to move from an open configuration to a closed configuration where the members form and enclose a space. Complementary latch elements on the members engage and hold the members in the closed configuration. At least one of the members has a tack extending inwardly into the space enclosed by the members. This tack pierces a garment intended to be protected by the tag and maintains the tag on the garment. At least one of the members has at least one perforated line across the width of the member. This perforated line allows that member to be pulled apart and the tag removed without the need of any tool to do so.

17 Claims, 3 Drawing Sheets

(56) References Cited

U.S. PATENT DOCUMENTS

| | | | |
|---|---|---|---|
| 7,227,467 | B2 | 6/2007 | Feibelman |
| 7,249,401 | B2 | 7/2007 | Copen et al. |
| 7,400,254 | B2 | 7/2008 | Yang et al. |
| 7,474,222 | B2 | 1/2009 | Yang et al. |
| D599,242 | S | 9/2009 | Yang |
| D624,447 | S | 9/2010 | Yang |
| 7,817,041 | B2 | 10/2010 | Skjellerup et al. |
| 7,969,310 | B2 | 6/2011 | Sayegh |
| D649,898 | S | 12/2011 | Yang |
| 8,144,014 | B1 | 3/2012 | Yang |
| 8,223,022 | B2 | 7/2012 | Skjellerup et al. |
| 8,242,915 | B2 | 8/2012 | Yan et al. |
| 8,269,631 | B2 | 9/2012 | Yang |
| 8,305,219 | B2 | 11/2012 | Yang |
| 8,368,543 | B2 | 2/2013 | Yang |
| 8,416,082 | B2 | 4/2013 | Sayegh et al. |
| 8,421,633 | B2 | 4/2013 | Yang |
| 8,451,128 | B2 | 5/2013 | Yang |
| 8,547,229 | B2 | 10/2013 | Brodzik et al. |
| 8,624,739 | B2 | 1/2014 | Forster |
| 8,665,095 | B2 | 3/2014 | Yang |
| 2007/0252707 | A1 | 11/2007 | Seidel |
| 2009/0045258 | A1 | 2/2009 | Sabeta |
| 2009/0212920 | A1 | 8/2009 | Yang |
| 2010/0050487 | A1 | 3/2010 | Weightman et al. |
| 2010/0277323 | A1 | 11/2010 | Feibelman et al. |
| 2012/0235818 | A1* | 9/2012 | Forster ..... E05B 73/0017 340/572.1 |
| 2012/0323807 | A1 | 12/2012 | Sabeta |
| 2013/0133380 | A1 | 5/2013 | Will |
| 2013/0133381 | A1 | 5/2013 | Will |
| 2014/0159902 | A1 | 6/2014 | Yang |
| 2015/0161863 | A1 | 6/2015 | Yang |
| 2016/0063830 | A1* | 3/2016 | Glamuzina, Jr. .. G08B 13/2462 340/572.1 |

* cited by examiner

ANTI-FRAUD TAG

CROSS REFERENCE TO RELATED APPLICATIONS

This application is a continuation of U.S. patent application Ser. No. 14/606,351 filed on Jan. 27, 2015, and published as U.S. 2015/0161863, which has issued as U.S. Pat. No. 9,324,221. U.S. patent application Ser. No. 14/606,351 is a continuation-in-part application based on U.S. patent application Ser. No. 14/099,788 filed on Dec. 6, 2013, and published as Patent Application Publication U.S. 2014/0159902 A1, which has issued as U.S. Pat. No. 9,355,539. U.S. patent application Ser. No. 14/099,788 claims priority to U.S. Provisional Application 61/734,478 filed on Dec. 7, 2012. The entire disclosures contained in U.S. patent application Ser. Nos. 14/606,351, 14/099,788, and 61/734,478, including the attachments thereto, are incorporated herein by reference.

FIELD OF THE INVENTION

This invention relates to the prevention of the fraudulent return of purchased goods. More specifically, this invention relates to the prevention of the return of garments which have been purchased, worn, and then returned to the store after having been worn.

BACKGROUND OF THE INVENTION

Theft of goods in the retail environment is a serious concern. Theft cuts into the margins of a business making it more difficult for a business to compete and succeed. One type of theft is fraudulently returned garments. This type of theft involves purchasing a garment, perhaps a more expensive high end garment, and wearing it at least once. After the garment has been worn, it is fraudulently returned to the retail outlet where it was purchased. This allows the purchaser to get the good of the product without paying for it. This frequently occurs when a person purchases a more expensive article of clothing for a particular occasion, wears the garment, and then returns it.

SUMMARY FOR EMBODIMENTS OF THE INVENTION

Embodiments of the current invention entail a highly visible tag that can be attached to the garment at the store, but can easily be removed once the purchaser buys the garment and takes it home. Once the purchaser gets the garment home, they can remove it themselves and wear it. Once the tag is removed, it can not be reattached by the consumer. In at least one embodiment, the tag is broken into multiple pieces when it is removed. Depending on the store policy, the garment may not be returned, or there may be an extra fee for returning the garment, or other similar policies. The use of a tag makes it clear that the buyer has removed the tag and provides an indication that the garment has been worn in public.

In at least one embodiment, the tag consists of an elongated plastic piece having a hinge in the middle so that it can fold over. At one end of the elongated plastic piece is a tack, and at the other end, coincident with the tack when the tag is folded, is an aperture. When the tag is folded the tack inserts into the aperture, and passes through any fabric between the folded ends of the tag. In proximity to the tack is a first element for holding the tag in a folded position, and in proximity to the aperture is a second element for holding the tag in a folded position. These two elements engage each other when the tag is folded and keep the tag in the folded state. This keeps the tack inserted through the aperture and garment.

In some embodiments, the tag has a medallion attached to the body of the tag and there is a continuous series of perforations through the body of the tag in proximity to the medallion. The medallion has an exposed edge which presents a tab for grasping. In embodiments having the medallion and perforations, one way to remove the tag from the garment is to tear the tag at the perforations. A buyer turns or pulls the exposed edge (tab) of the medallion and tears the body of the tag into multiple pieces along the lines of the perforations in the tag. Once the body of the tag is torn in this fashion the holding elements can be disengaged with ease and the tag removed from garment without damaging the garment.

In some embodiments, the first holding element, the second holding element or both, have a continuous series of perforations around them where they join the body of the tag. To remove the tag, a buyer pulls the two ends of the tag apart tearing the perforations around a holding element. When the perforations around a holding element tear, the holding elements can remain joined, while the two ends of the tag separate. With the separation of the ends of the tag, the tack is withdrawn from the slot and the garment, and the tag can be removed from the garment.

BRIEF DESCRIPTION OF THE DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS

Figure 1:
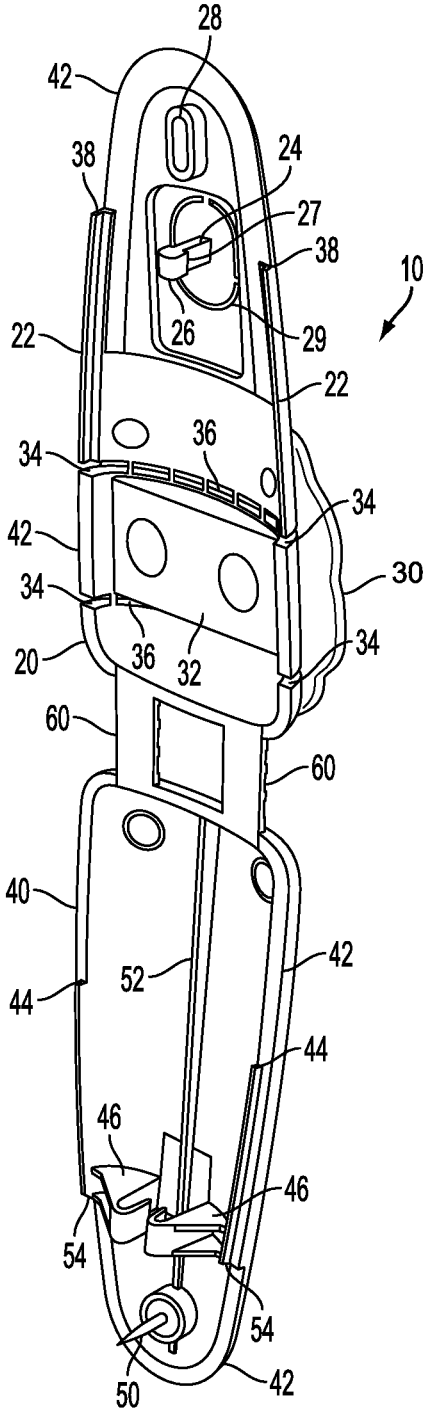
FIG. 1 is a bottom perspective view of a snap tag in an opened configuration.
Figure 3:
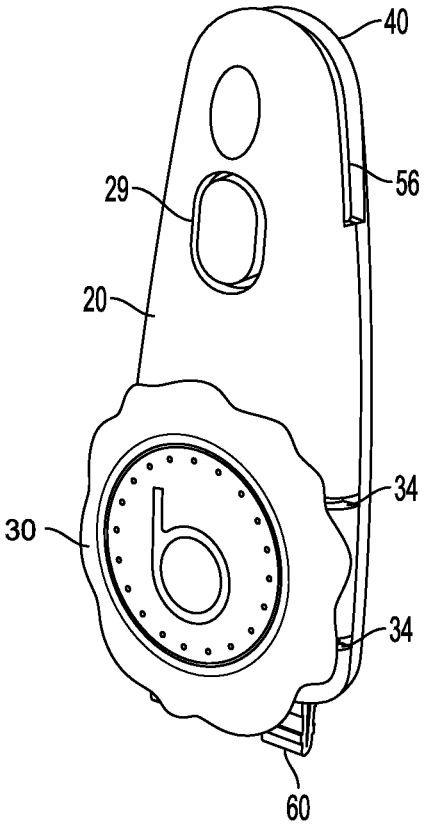
FIG. 3 is a top perspective view of a snap tag in a closed configuration.

FIG. 1 is a bottom perspective view of an open snap tag 10. In the embodiment of FIG. 1, snap tag 10 comprises a top member 20, a bottom member 40, and a hinge, or hinges, 60 connecting top member 20 and bottom member 40. Top 20 and bottom 40 members are each concave and have edges, or perimeters, 42 generally matching each other. When snap tag 10 is folded at hinge 60 to bring top member 20 together with bottom member 40, they form a generally hollow body (See FIG. 3). Edges 42 of top member 20 and bottom member 40 may have complimentary ridges 22 and 44. In the embodiment shown in FIG. 1, ridges 22 are outside ridges and ridges 44 are inside ridges. Ridges 22 and 44 overlap each other when snap tag 10 is closed to provide greater ridgity in the closed configuration. Rib 52 on the interior surface of bottom member 40 provides rigidity in bottom member 40 and to anti-fraud tag 10 when it is in close configuration. Both top member 20 and bottom member 40 have recessed steps 38 and 54 respectively at their ends to create gap 56 (See FIG. 3) between their ends when snap tag 10 is closed. This leaves some space for the material of the garment.

Opposing hooks 46 are located within bottom member 40. Peg 24 is located within top member 20. Hooks 46 and peg 24 are positioned on the interior surface of their respective members so that when snap tag 10 is closed, peg 24 inserts in between hooks 46. Peg 24 has an expanded head 26 on it which creates shoulders 27. When peg 24 inserts between hooks 46, hooks 46 latch to shoulders 27 on peg 24 and hold snap tag 10 in a closed position.

Tack 50 is also located within bottom member 40. Aperture 28 is also within top member 20. When snap tag 10 is closed, tack 50 passes through the garment to which snap tag 10 is attached and inserts into aperture 28. This keeps snap tag 10 attached to the garment. In the embodiment shown in FIG. 1, aperture 28 is elongated.

Top member 20 has a continuous series of perforations 29 through it around the base of peg 24. To remove tag 10 from a garment, the buyer pulls top member 20 and bottom member 40 apart at the ends with enough force to tear perforations 29 about peg. This separates peg 24 from the rest of top member 20 which allows tag 10 to be fully opened, removing tack 50 from the garment, which allows the removal of tag 10 from the garment. This also prevents the forced separation of the holding elements while the tag stays intact. Perforations 20 in top member 20 cause the peg 24 to break away from top member 20 before the holding elements peg 24 and hooks 46 disengage.

Figure 2:
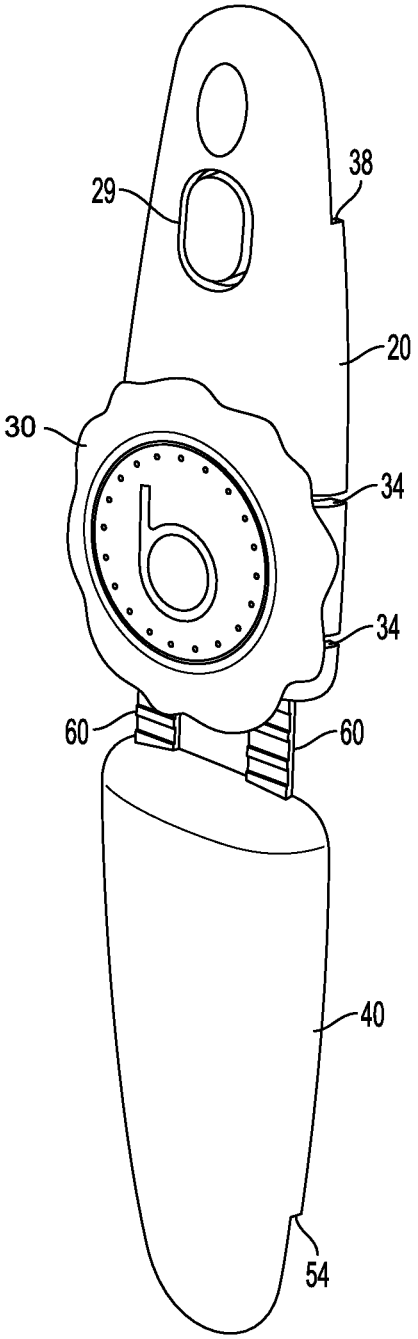
FIG. 2 is a top perspective view of a snap tag in an open configuration.

Turning now to FIG. 2, FIG. 2 is a top perspective view of snap tag 10 in an open configuration. This view shows the surfaces that will be the external surfaces of tag 10 in its closed configuration. Medallion 30 is located on the top of top member 20 of snap tag 10. The edge of Medallion 30 extends from top member 20, presenting a tab. Returning to FIG. 1, panel 32 may be seen on the bottom of top member 20. Medallion 30 and panel 32 are joined together. Notches 34 at the edges 42 of top member 20 align generally with panel 32 and medallion 30. Referencing FIG. 1, perforations 36 extend through top member 20 in general alignment with notches 34 and extend across top member 20 in vicinity of panel 32 and medallion 30. Notches 34 may also be seen in FIGS. 1 and 3. Perforations 28 around peg 24 can also be seen in FIGS. 1 and 3.

In use, snap tag 10 is closed upon an object, such as a garment, and tack 50 passes through the garment, or object, and into aperture 28. Peg 24 fits into hooks 46 which latch onto shoulders 26 on peg 24 to hold tag 10 in the closed position attached to the garment. A buyer purchases the garment and takes it home. When the buyer decides to keep and wear the garment, the buyer may remove the tag. In the embodiment shown in FIGS. 1-3, removal of the tag is accomplished by breaking perforations 28 around peg 24 or perforations 36 across the width of top member 20.

Breaking the set of perforations 36 along medallion 30 is facilitated by pulling or turning medallion 30. Notches 34 and perforations 36 in top member 20 allow the pulling or turning of medallion 30 to separate top member 20 into pieces. Once top member 20 is parted, peg 24 can be removed from hooks 46 which allows snap tag 10 to be removed from the garment.

Alternatively, a buyer can break perforations 28 around peg 24. To do this, a buyer pull or pries apart the ends of top member 20 and bottom member 40. When perforations 28 around peg 24 are broken, tag 10 can be opened, which withdraws tack 50 from the garment, allowing tag 10 to be removed. This also prevents tag 10 from being removed from the garment intact, in which case it could be reattached.

It is to be understood that the embodiments and arrangements set forth herein are not limited in their application to the details of construction and arrangement of the components set forth in the description and illustrated in the drawings. Rather, the description and the drawings provide examples of the embodiments envisioned, but the invention is not limited to the specific embodiments. The embodiments disclosed herein are further capable of other embodiments and of being practiced and carried out in various ways, including various combinations and sub-combinations that may not have been explicitly disclosed. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other structures, methods, and systems for carrying out the several purposes of the embodiments and claims presented in this application. It is important, therefore, that the invention be regarded as including such equivalent constructions.

I claim:

1. A single use anti-fraud tag, comprising:

a first member having an interior surface, a second member having an interior surface, and a hinge connecting said first and second members, said hinge allowing said members to move from an open configuration to a closed configuration wherein said interior surfaces face each other and enclose an interior space;

each said first member and second member having a complimentary latching element extending from their interior surface, said latching elements engaging with each other to maintain said first member and second member in said closed configuration, said latching elements being inaccessible when said members are in the closed configuration;

a tack extending from said interior surface of either said first member or said second member, said tack located at an end opposite to said hinge, said tack inserting into an item when said first member and said second member are closed on the item in said closed configuration, said tack maintaining the tag attached to the item; and a continuous series of perforations in said first member, said continuous series of perforations allowing said first member to be manually parted to remove the tag from the item without the use of a tool.

2. The single use anti-fraud tag of claim 1, wherein:

said continuous series of perforations circumscribes the latching element on said first member where said latching element joins said first member.

3. The single use anti-fraud tag of claim 1, wherein:

said continuous series of perforations extends across the width of said first member.

4. The single use anti-fraud tag of claim 3, further comprising:

a tab attached to the exterior of said first member, said tab attached to said first member proximal to said continuous series of perforations.

5. The single use anti-fraud tag of claim 4, further comprising:

a logo on said tab.

6. The single use anti-fraud tag of claim 1, wherein:

the member not having said tack comprises an aperture positioned to receive said tack when said tag is in said closed configuration.

7. The single use anti-fraud tag of claim 1, wherein:

said first member, said second member, and said hinge of said tag are of unitary construction.

8. A single use anti-fraud tag, comprising:

a first member having an interior surface;

a second member having an interior surface;

each said first member and second member having a complimentary latching element extending from their interior surface;

a hinge connecting said first and second members, said hinge allowing said first member and said second member to move from an open configuration to a closed configuration with said interior surfaces facing each other, said complimentary latching elements latching and holding said first and second members in said closed configuration; and a tack extending from the interior surface of either said members and extending through an item to attach said tag to the item when said tag is closed on the item; and a continuous series of perforations in said first member, said continuous series of perforations allowing said first member to be manually parted to remove the tag from the item without the use of a tool.

9. The single use anti-fraud tag of claim 8, wherein:

said continuous series of perforations circumscribes the latching element on said first member where said latching element joins said first member.

10. The single use anti-fraud tag of claim 8, wherein:

said continuous series of perforations extends across the entire width of said first member.

11. The single use anti-fraud tag of claim 10, further comprising:

a tab attached to the exterior of said first member, said tab attached to said first member proximal to said continuous series of perforations.

12. The single use anti-fraud tag of claim 11, further comprising:

a logo on said tab.

13. The single use anti-fraud tag of claim 8, wherein:

the member not having said tack comprises an aperture positioned to receive said tack when said tag is in said closed configuration.

14. A single use anti-fraud tag comprising:

an elongated plastic piece having a hinge in the middle, one side of said plastic piece comprising internal surfaces;

said hinge dividing said plastic piece approximately into two halves, each half of said plastic piece being generally symmetrical in outline across said hinge;

each of said halves having complimentary holding elements extending from their internal surfaces, wherein when said plastic piece is folded at said hinge to a closed configuration and said internal surfaces are brought together, said holding elements engage each other to hold said plastic piece in said closed configuration;

one of said halves having a tack extending from its internal surface, wherein when said elongated plastic piece is folded to said closed configuration about an item, said tack pierces the item and maintains said tag on said item; and one of said halves having a continuous series of perforations, said continuous series of perforations allowing that half to be manually parted to remove the tag from the item without the use of a tool.

15. The single use anti-fraud tag of claim 14, wherein:

said continuous series of perforations circumscribes the holding element on one of said halves where said holding element joins that half.

16. The single use anti-fraud tag of claim 14, wherein:

said continuous series of perforations extends across the entire width of one of said halves.

17. The single use anti-fraud tag of claim 16, further comprising:

a tab attached to the exterior of the half having the continuous series of perforations across its width, said tab attached to that half proximal to said continuous series of perforations.

* * * * *